United States Patent [19]

Steinke

[11] 4,074,800

[45] Feb. 21, 1978

[54] ENDLESS PRINTER RIBBON CARTRIDGE APPARATUS

[75] Inventor: James M. Steinke, Longwood, Fla.

[73] Assignee: TRW Inc., Los Angeles, Calif.

[21] Appl. No.: 784,078

[22] Filed: Apr. 4, 1977

[51] Int. Cl.[2] ..... B41J 33/10

[52] U.S. Cl. ..... 197/168; 197/151

[58] Field of Search ..... 197/151, 168; 242/55.19 A; 526/249

[56] References Cited

U.S. PATENT DOCUMENTS

| | | | |
|---|---|---|---|
| 2,792,377 | 5/1957 | Miller | 526/249 X |
| 2,888,446 | 5/1959 | Herbst et al. | 526/249 X |
| 3,004,961 | 10/1961 | Hauptschein | 526/249 |
| 3,343,759 | 9/1967 | Kallay | 242/55.19 A |
| 3,490,671 | 1/1970 | Hladky | 197/168 UX |
| 3,497,411 | 2/1970 | Chebiniak | 101/382 MV X |
| 3,524,602 | 8/1970 | Greene et al. | 197/168 X |
| 3,918,569 | 11/1975 | Parker | 197/168 |
| 3,993,182 | 11/1976 | Steinke | 197/168 |
| 4,011,933 | 3/1977 | Kern | 197/151 |

*Primary Examiner*—Paul T. Sewell

*Attorney, Agent, or Firm*—Duckworth, Hobby & Allen

[57] ABSTRACT

An endless ribbon printer cartridge apparatus in which a cartridge housing is provided with improved ribbon guides for directing the ribbon along a predetermined path and with wrapping members molded into the casing thereby eliminating wrapping rollers. An antifold wrapping member removes folds in the ribbon from the drive mechanism and assists in the wrapping of the ribbon.

9 Claims, 5 Drawing Figures

ENDLESS PRINTER RIBBON CARTRIDGE APPARATUS

BACKGROUND OF THE INVENTION

The present invention relates to ribbon cartridges and especially to a cartridge for an endless inked ribbon for a printing mechanism for use with computer terminals and the like.

Prior art ribbon cartridges have the advantage of ease in loading without the attendant hazard of smudging ink on unwanted surfaces, and messy operator handling. The principal disadvantages of available cassettes are inherent complexity resulting in high cost of fabrication and limitations of yardage of inked ribbon relative to available space to accommodate the cartridge. Some prior devices satisfy in part the volume per character printed capability, such as the Parker U.S. Pat. No. 3,918,569, assigned to the assignee of the present invention, which employs a wound bobbin of ribbon which affords a greater length of ribbon within a given space than could be loaded by a "Stuffing box" apparatus, owing to an allowance of space for a packing factor required to avoid creasing or folding of the ribbon. However, the practical reduction of the art taught in the Parker patent is known to require extremely stringent control of the inked coating and winding processes to prevent stressed ribbon from causing early malfunction. These shortcomings were circumvented by the applicant's prior application Ser. No. 622,223, now U.S. Pat. No. 3,993,182, which introduced specific considerations regarding ribbon length, friction and low friction plastics in combination.

In contrast with my prior invention, this invention teaches features which allow a greater tolerance of ribbon conditions while allowing simplicity of fabrication and a reduction of cost. The present ribbon cartridge provides a pre-inked endless ribbon and housing especially suitable for printer mechanisms in computer terminals and point-of-sale devices and the like, accommodating a variety of printer heads including character wheel and wire matrix. The cartridge is adapted to attach easily to a print head and move horizontally with the head as the printer head moves from one horizontal position to another.

SUMMARY OF THE INVENTION

The present invention relates to an endless inked ribbon cartridge having a housing with a bottom and a plurality of sides and formed to include a pair of protruding arms. A top cover attaches to the housing to enclose the housing and an endless ribbon is partially wrapped around arcuate wrapping members for a plurality of turns so as to leave a space between the wrapping members. The wrapping members are formed or fixedly attached to the housing bottom with one arcuate member turning sharply in between the pair of arcuate members to guide the inside loop of the wrapped ribbon towards the spacing between the wrapping member. A ribbon guide on the cover directs the ribbon coming off the inside of the wrapped portion at a sharp angle where it is flattened by a guide member formed between the wrapping members. An additional guide and spacing member is located to receive the crinkled ribbon passing through the cartridge drive means to straighten the ribbon and wrap it smoothly on the wrapped portion of the ribbon, and at the same time keep the wrapped portion in position. The fixed arcuate wrapping members are made of polymer materials and impregnated with solid lubricant materials, such as an acetal resin impregnated with various amounts of polytrifluorochloroethylene.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
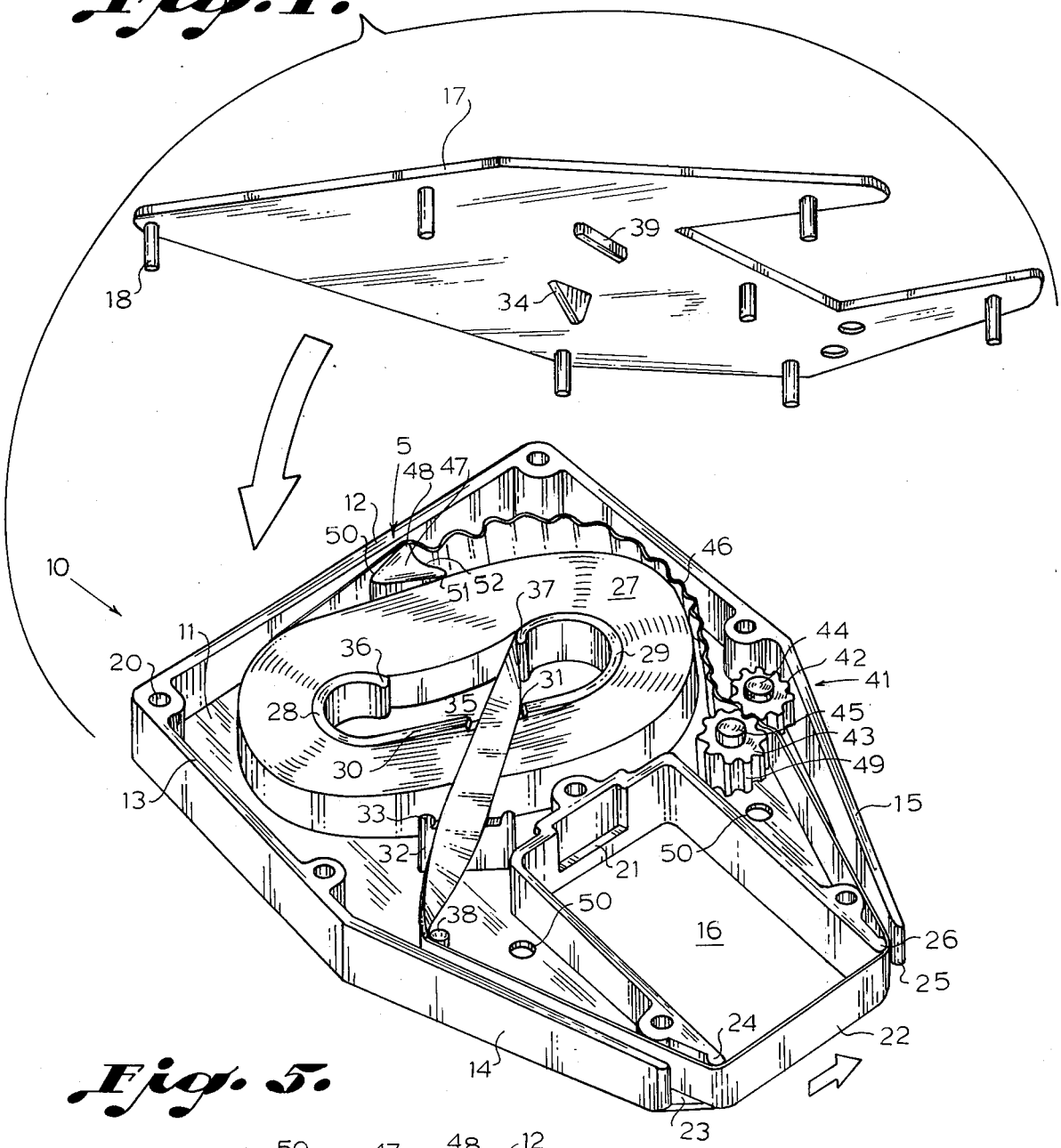
FIG. 1 is an exploded perspective view of a ribbon cartridge having the cover removed to show the operation of the cartridge.

Referring now to FIGS. 1 through 5, the preferred embodiment of an endless inked ribbon cartridge is illustrated having a housing 10 having a base 11, a rear side wall 12, a pair of side walls 13 and a pair of protruding arms 14 and 15, forming a space 16 therebetween. A cover 17 has a plurality of posts 18 positioned to fit into a plurality of openings 20 in the base portion of the housing 10 for sealing the cover to the housing. A snap catch ledge 21 is located between the arms 14 and 15 in the exterior of the housing 10 to allow the cartridge to be snapped into a printing mechanism so that the printing wheel can be positioned in the space 16 for typing against the ribbon 22 as it passes between the arms 14 and 15 crossing the space 16. An opening 23 on the end of arm 14 has an arcuate exit surface 24 while the entrance opening 25 in the arm 16 has an arcuate capturing surface 26 to direct the ribbon 22 from the arm 14 to the arm 15. The major portion of the ribbon 22 is the wrapped portion 27 which is wrapped around an arcuate wrapping member 28 and a second arcuate wrapping member 29. The arcuate members 28 and 29 are molded to the bottom 11 of the housing 10 and are made of self-lubricating polymer materials such as an acetal resin impregnated with approximately 40% polytrifluorochloroethylene. This self-lubricating material allows the ribbon 22 wrapped portion 27 to easily slide on the arcuate members 28 and 29 without the use of spools or rollers separately mounted to roll on the casing and thereby reducing the complexity in assembly time for the cartridge. The arcuate wrapping members 28 and 29 are connected by a spacing 30 and have a ribbon guide 31 formed therein for guiding the ribbon as it comes off the inner loop over the wrapped portion 27 onto a guide 32 which guide has a pair of guiding posts 33 thereon for holding the ribbon flat as it passes over the wrapped portion 27. In addition to the guide 31, an angled guide member 34 is molded into the top 17 at an angle such as 45° and is positioned so that when the top is attached the guide 34 will protrude in the spacing 35 between the arcuate members 28 and 29 to guide the ribbon 22 as it comes off the wrapping member 29 in the spacing 35. A second guide 39 is molded on the top 17 to position the ribbon 22 from the top. The arcuate member 28 extends into the spacing 35 at 36 so as to avoid the wrapped ribbon 27 from scraping against the edge thereof while the arcuate member 29 has a guide surface 37 that extends around and well into the spacing 35 at an angle to direct the ribbon 22 coming off the inner loop of the wrapped portion 27 towards the guide 31. Thus, the curved portion 37 of the wrapping portion 29 acts as a guide for the exiting ribbon and acts in conjunction with the guide member 34, guide member 31, and guide member 32 to direct the ribbon from a vertical standing position to a horizontal position to pass over the wrapped portion 27 of the ribbon. Once the ribbon passes over the guide 32, it is captured by a guide member 38 which straightens the ribbon into a vertical position where it is directed along its path between a protruding portion and the outer arm wall of the arm 14 with the protruding portion also acting as a receptacle for a post 18.

Once the ribbon has passed across the gap 16, and back into the arm 15, it is directed through a drive mechanism 41 having a drive gear 42 and one or more idler gears 43. Drive gear 42 has a drive shaft 44 while the idler gear 43 is pinned with a pin 45 to the base 11 of the housing 10. The gears 42 and 43 each have gear teeth 49 and are spaced to bend the ribbon 22 at an angle as it passes therethrough. However, once the ribbon passes through the drive mechanism 41, the ribbon has a plurality of creases 46 formed therein by the gear teeth 49. The ribbon thereafter passes between a guide 5 comprising an anti-fold control wedge 47 which is molded into the housing 10 on the base 11 at a predetermined position and may be molded of the same material as the arcuate wrapping members 28 and 29. The wedge 47 has three smoothly curved surfaces 48, 50, and 51, and is spaced so that the curbed surface 48 is a predetermined distance from the rear side 12, which distance may be approximately one hundredths of an inch (0.01) which is spaced to allow or meter only one ribbon thickness to pass while straightening out the wrinkles or folds 46, and then to direct the ribbon along the curved surface 50 where it has been wrapped onto the exterior of the wrapped portion 27 of the ribbon 22. In addition, the wedge 47 has the curved tip 51 which presses against the outer wrapped portion of the wrapped ribbon 27, for maintaining the ribbon in a tightly wrapped wrapping around the wrapping members 28 and 29. Wedge member 47 also has a concave surface 52 between the curved tips 51 and 48.

Figure 5:
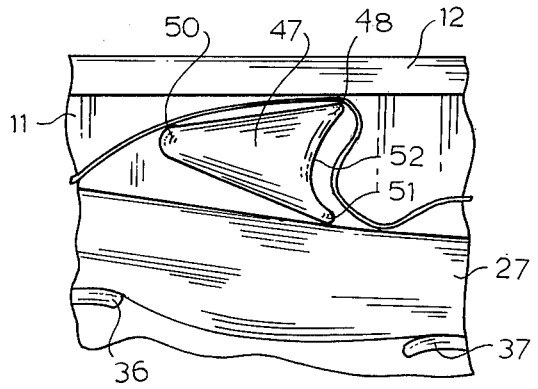
FIG. 5 is an enlarged plan view of the anti-fold control ledge and guide of the cartridge of FIGS. 1 through 4.
Figure 2:
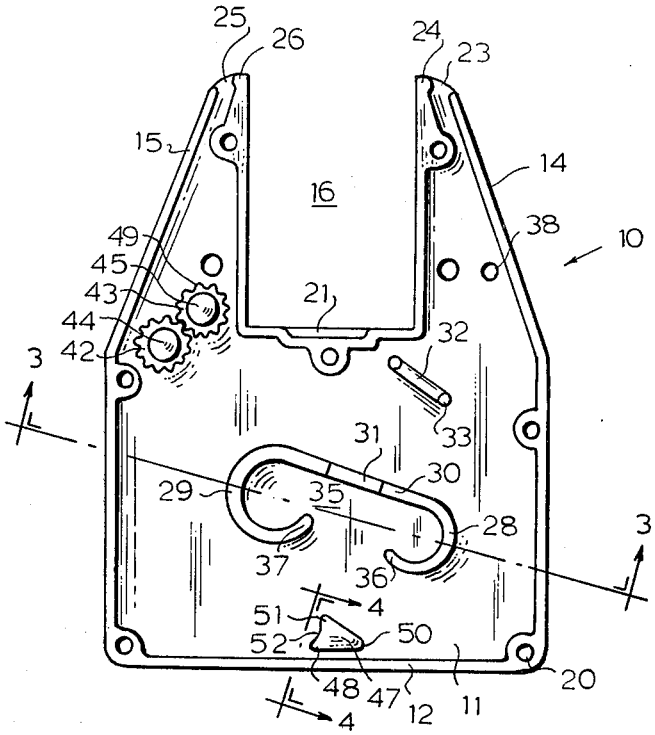
FIG. 2 is a top plan view of the cartridge having the cover and ribbon removed.
Figure 3:
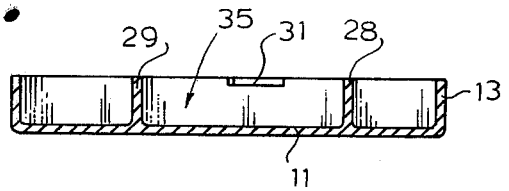
FIG. 3 is a sectional view taken on the Line 3—3 of FIG. 2.
Figure 4:
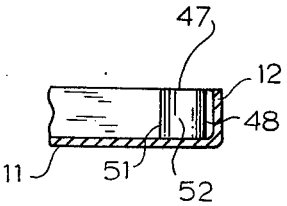
FIG. 4 is a sectional view taken on the Line 4—4 of FIG. 2.

As can be seen in the Figures and especially in FIG. 5, the wedge member 47 serves to straighten out folds 46 and ribbon 22 from the drive mechanism 41 and at the same time guides the ribbon onto the outer portion of the wrapped portion 27, and serves the additional function of maintaining the wrapped portion in a tight wrap, which is accomplished by putting the specially shaped wedge in the precise position required to utilize the rear side in the fold removal and by the predetermined shape to guide the ribbon in its path. In addition, the arcuate wrapping members 28 and 29 serve the added function of incorporating a guide 31 therebetween while the arcuate wrapping portion 29 has a guide 37 for the inner loop of the ribbon formed therein so as to serve a dual function. It should be clear at this point that the present cartridge can be molded in a single mold, with the top and the base being molded in separate molding cavities to provide a completed cassette except for attachment of the drive gears to complete the drive mechanism and the wrapping of the ribbon and the attachment of the top 17, thereby reducing the cost of making the cassette while providing a reliable cassette for use with high speed printers such as might be used in computer terminals, and the like.

It should be noted, however, that other variations are contemplated as being within the scope of the invention such as different drive mechanisms 41 can be utilized and for instance, may have two idler gears positioned adjacent a single drive gear. Also the spacing between the wrapping members 28 and 29 can be varied as desired. In addition to the wedge 21 between the arms 14 and 15 for attaching the cartridge to a printing mechanism a pair of openings 50 position the cartridge and a clip may be attached over the back of the cartridge to firmly position the cartridge in the printer. Thus, the present invention is not to be construed as limited to the particular forms disclosed herein, which are to be regarded as illustrative rather than restrictive.

I claim:

1. An endless printer ribbon cartridge comprising in combination:

a housing having a bottom and a plurality of sides, and formed to include a pair of protruding arms;

a top cover attached to said housing;

ribbon wrapping means fixedly attached to said housing bottom and having a pair of arcuate wrapping members for wrapping an endless ribbon around;

an endless ribbon having a partially wrapped portion wrapped around said pair of arcuate wrapping members for a plurality of turns so as to leave a space therebetween;

a ribbon guide fixedly attached to said ribbon wrapping means between said partially wrapped portion of said endless ribbon for guiding said ribbon from between said pair of arcuate wrapping members over said partially wrapped portion of said endless ribbon;

ribbon drive means located in said housing and engaging said ribbon for driving said ribbon over a predetermined path from between said ribbon wrapping means wrapping members over a predetermined ribbon path between said protruding arms and onto the outside of said partially wrapped ribbon on said ribbon wrapping means whereby an endless ribbon cartridge is formed; and a ribbon straightening member having a plurality of lips thereon, one said lip being spaced a predetermined distance from one said housing side for metering ribbon onto said partially wrapped ribbon and for straightening said ribbon and a second said lip located adjacent to and pressing against said partially wrapped ribbon portion for maintaining said wrapped portion in a tight wrap.

2. An endless printer ribbon cartridge in accordance with claim 1, in which said ribbon wrapping means has said pair of arcuate wrapping members connected to said ribbon guide therebetween.

3. An endless printer ribbon cartridge in accordance with claim 2, in which one said ribbon wrapping means wrapping member has a curved ribbon guide means formed on the end thereof for directing the inside loop of said partially wrapped ribbon onto said guide formed between said arcuate wrapping members.

4. An endless printer ribbon cartridge in accordance with claim 3 in which said arcuate wrapping members are formed of an acetal resin impregnated with polytrifluoro-chloroethylene.

5. An endless printer ribbon cartridge in accordance with claim 3, in which a ribbon guide is fixedly attached to said top cover for protruding into a space between said ribbon wrapping means arcuate wrapping members for twisting said ribbon from said inner loop at a predetermined angle.

6. An endless printer ribbon cartridge in accordance with claim 1, in which said ribbon straightening member one said lip is spaced approximately 0.01 inch from said housing side.

7. The endless printer ribbon cartridge in accordance with claim 6, in which said ribbon straightening member has a third lip for directing said ribbon onto the outer wrap of said partially wrapped ribbon wrapped on said ribbon wrapping means.

8. The apparatus in accordance with claim 7, in which said ribbon straightening member has a wedge shape having three curved lips.

9. The apparatus in accordance with claim 8, in which said ribbon straightening member has a concave arcuate surface between said first and second lips.

* * * * *